US011310579B2

(12) United States Patent
Lefebvre et al.

(10) Patent No.: US 11,310,579 B2
(45) Date of Patent: Apr. 19, 2022

(54) HEADSET

(71) Applicant: SHENZHEN GRANDSUN ELECTRONIC CO., LTD., Guangdong (CN)

(72) Inventors: Mickael Bernard Andre Lefebvre, Guangdong (CN); Haiquan Wu, Guangdong (CN); Zhongqiang Tang, Guangdong (CN); Shiwen Guo, Guangdong (CN); Xin Yu, Guangdong (CN); Jiugao Peng, Guangdong (CN); Ruiwen Shi, Guangdong (CN)

(73) Assignee: SHENZHEN GRANDSUN ELECTRONIC CO., LTD., Guangdong (CN)

( * ) Notice: Subject to any disclaimer, the term of this patent is extended or adjusted under 35 U.S.C. 154(b) by 191 days.

(21) Appl. No.: 16/626,239

(22) PCT Filed: Oct. 16, 2019

(86) PCT No.: PCT/CN2019/111507
§ 371 (c)(1),
(2) Date: Dec. 23, 2019

(87) PCT Pub. No.: WO2020/252998
PCT Pub. Date: Dec. 24, 2020

(65) Prior Publication Data

US 2021/0337295 A1 Oct. 28, 2021

(30) Foreign Application Priority Data

Jun. 21, 2019 (CN) ..... 201920971103.0
Jul. 31, 2019 (CN) ..... 201921233491.9
(Continued)

(51) Int. Cl.
*H04R 1/10* (2006.01)

(52) U.S. Cl.
CPC ..... *H04R 1/1008* (2013.01); *H04R 1/105* (2013.01)

(58) Field of Classification Search
CPC . H04R 1/00; H04R 1/008; H04R 1/02; H04R 1/026; H04R 1/028; H04R 1/10;
(Continued)

(56) References Cited

U.S. PATENT DOCUMENTS 8,605,935 B1 * 12/2013 Huang ..... G02C 11/10 381/381
8,774,420 B2 * 7/2014 Belafonte ..... H04R 1/2811 381/74
(Continued)

FOREIGN PATENT DOCUMENTS

CN 103237278 A 8/2013
CN 203645806 U 6/2014
(Continued)

OTHER PUBLICATIONS

International Search Report in corresponding PCT Application No. PCT/CN2019/I 1 1507, dated Mar. 20, 2020.

*Primary Examiner* — Thang V Tran
(74) *Attorney, Agent, or Firm* — Leason Ellis LLP

(57) ABSTRACT

The present application discloses a headset, the headset includes a headband; and two earphones respectively connected to two ends of the headband and including: an earphone housing connected to an end of the headband; an earmuff provided therein with a sounder; and a universal adjuster connected between the earphone housing and the earmuff and configured to arbitrarily adjust the earmuff relative to the earphone housing. The headset improves the fit of the earmuffs and the human ears, and improves the comfort when wearing.

20 Claims, 13 Drawing Sheets

(30) Foreign Application Priority Data

Jul. 31, 2019 (CN) ..... 201921233493.8
Jul. 31, 2019 (CN) ..... 201921252297.5
Jul. 31, 2019 (CN) ..... 201921257884.3

(58) Field of Classification Search
CPC .... H04R 1/105; H04R 1/1058; H04R 1/1066; H04R 1/1075; H04R 5/033; H04R 5/0335
See application file for complete search history.

(56) References Cited

U.S. PATENT DOCUMENTS

| | | | | |
|---|---|---|---|---|
| 9,084,055 | B2 * | 7/2015 | Brunner | H04R 1/1091 |
| 2014/0211976 | A1 * | 7/2014 | Brunner | H04R 1/1091<br>381/374 |
| 2016/0192061 | A1 * | 6/2016 | Hsiao | H04R 1/1016<br>381/371 |
| 2016/0277822 | A1 * | 9/2016 | Blair | H04R 31/00 |

FOREIGN PATENT DOCUMENTS

| | | | | |
|---|---|---|---|---|
| CN | 203708429 | U | * | 7/2014 |
| CN | 203708429 | U | | 7/2014 |
| CN | 204442621 | U | | 7/2015 |
| EP | 1095643 | A2 | | 5/2001 |

* cited by examiner

HEADSET

CROSS-REFERENCE TO RELATED PATENT APPLICATIONS

This application is a U.S. National Phase Application under 35 U.S.C. §371 of International Patent Application No. PCT/CN2019/111507, filed Oct. 16, 2019, and claims the priorities of Chinese Patent Application No. 201920971103.0, entitled "An earmuff adjusting structure for headset and headset", filed on Jun. 21, 2019, in the Chinese Patent Office; Chinese Patent Application No. 201921252297.5, entitled "An universal adjuster and headset", filed on Jul. 31, 2019, in the Chinese Patent Office; Chinese Patent Application No. 201921257884.3, entitled "An universal adjusting film structure and headset", filed on Jul. 31, 2019, in the Chinese Patent Office; Chinese Patent Application No. 201921233493.8, entitled "A headset", filed on Jul. 31, 2019, in the Chinese Patent Office; and Chinese Patent Application No. 201921233491.9, entitled "A headset", filed on Jul. 31, 2019, in the Chinese Patent Office, all of which are incorporated by reference in their entireties.

TECHNICAL FIELD

The present application relates to the technical field of headphone, and more particularly to a headset.

BACKGROUND TECHNOLOGY

The structure of the existing headphones generally includes a headband and two earphones respectively connected to two ends of the headband. Although in the existing common headphones, the earphones and the headband can achieve a certain angular adjusting, however, this adjusting is mostly a limited angular adjusting in a certain direction, which leads to the earphones and the user's ears fit will not be ideal during the wearing process, thereby the fit of the wear is affected and the comfort of wearing the headphone is affected.

SUMMARY

One of objects of embodiments of the present application is to provides a headset, in order to solve the problem that the headset and the user's ears fit is not ideal and the comfort of wearing the headphone is affected.

In order to solve the technical problem above mentioned, the technical solution adopted in embodiments of the present application are;

A headset is provided, and the headset includes a headband; and two earphones, respectively connected to two ends of the headband, wherein each earphone including:

an earphone housing, connected to an end of the headband;

an earmuff provided with a built-in sounder; and a universal adjuster, connected between the earphone housing and the earmuff and configured to arbitrarily adjust the earmuff relative to the earphone housing.

In an embodiment, an upper end of the earphone housing is connected with the headband, and a lower end is provided with a connecting ring annularly disposed, an outer end of the earmuff away from an ear is located in a space enclosed by an inner annular surface of the connecting ring; and the universal adjuster is connected between the connecting ring and the outer end of the earmuff, and configured to allow the earmuff to be adjusted relative to the earphone housing.

In an embodiment, the universal adjuster is made of a material of at least one of the group of elastic silicone, elastic rubber, elastic plastic, elastic fabric and elastic film material.

In an embodiment, the universal adjuster is a universal adjusting film made of an elastic film material, and the universal adjusting film is annularly disposed, an outer annular surface of the universal adjusting film is connected to an inner annular surface of the connecting ring, and an inner annular surface of the universal adjusting film is connected to an outer edge of an outer end of the earmuff.

In an embodiment, the universal adjusting film is connected to the connecting ring and the earmuff by an overmolding sealing, and a region between the outer annular surface and the inner annular surface of the universal adjusting film is annularly disposed in a concave-convex three-dimensional shape.

In an embodiment, the outer annular surface of the universal adjusting film and the inner annular surface of the connecting ring is welded by ultrasonic sealing, and the inner annular surface of the universal adjusting film and the outer edge of the outer end of the earmuff is welded by ultrasonic sealing.

In an embodiment, the outer annular surface of the universal adjusting film is provided with a first limiting portion, and the inner annular surface of the connecting ring is provided with a second limiting portion configured to be cooperated and connected with the first limiting portion, and an outer edge of the inner annular surface of the universal adjusting film extends outward to form a connecting flange.

In an embodiment, the connecting ring is disposed coaxially with the earmuff, and the universal adjusting film has a uniform width along each radial direction.

In an embodiment, the universal adjuster is a plurality of springs connected between the earphone housing and the earmuff.

In an embodiment, a number of the springs are four, and two of the springs are coaxially disposed opposite to each other, and the other two of the springs are also coaxially disposed opposite to each other; and an axes of the two opposite springs are perpendicular to an axes of the other two opposite springs.

In an embodiment, at least one end of the spring is pivotally connected to the earphone housing or the earmuff.

In an embodiment, the earmuff comprises an earmuff housing, an outer cover and an inner cover; the earmuff housing defines a mounting cavity designed having an opening outward, and a sounding assembly is placed in the mounting cavity, and the outer cover is detachably attached to the opening of the mounting cavity, and the inner cover is detachably connected with the earmuff housing.

In an embodiment, a plurality of first screw posts are spaced apart from each other on the inner surface of the outer cover, and each of the first screw posts is provided with a threaded hole having an internal thread, a bottom of the mounting cavity of the earmuff is protruded with second screw posts configured to be cooperated and connected with the first screw posts, and the second screw post is provided a through hole passing through the second screw post along an axial direction, and a connecting member passes through the through hole and is screwed to the first screw post.

In an embodiment, wherein an outer peripheral side of the earmuff housing comprises an annular retaining area located on a side adjacent to the connecting ring, and an inner side area located on a side away from the connecting ring, the retaining area is disposed in a concave annular groove, and the inner side area is provided with a first through hole configured for a connecting wire to be passed through.

In an embodiment, a top of the remaining area adjacent to the headband is provided with a second through hole, and the second through hole is in communicated with the sounding assembly.

In an embodiment, the headset further comprises a stretching arm structure and a connecting wire;

the stretching arm structure comprises a stretching arm and a position adjusting mechanism, and two ends of the stretching arm are respectively connected to the headband and the connecting ring, and the position adjusting mechanism is disposed between the stretching arm and the headband, the stretching arm is configured to adjust a relative position with the headband in an up and down direction by the position adjusting mechanism;

one end of the connecting wire passes through the headband and is electrically connected to the other earphone, and the other end is electrically connected to the sounding assembly after passing through the earmuff housing, and a part of the connecting wire located between the headband and the earmuff housing is a curved state.

In an embodiment, the stretching arm comprises a first connecting portion, a second connecting portion and a third connecting portion which are sequentially connected, and a bending curvature of the first connecting portion is in consistent with the headband and is connected to the headband; two ends of the second connecting portion are respectively connected to the first connecting portion and the third connecting portion, and the second connecting portion is in an arc-shaped design concaved inside; the third connecting portion is connected to the connecting ring and is in an arc-shaped design concaved outwardly.

In an embodiment, the stretching arm is integrally disposed with the connecting ring.

In an embodiment, the position adjusting mechanism comprises a resilient adjusting buckle disposed at a lower end of an outer side surface of the headband, and an adjusting latching position disposed at an inner side surface of the first connecting portion and extended along a length direction of the stretching arm, a section the adjusting latching position is in a sawtooth shaped, and with the adjusting buckle engaging at different positions of the adjusting latching position, the first connecting portion is achieved to adjust a position relative to the headband.

In an embodiment, a part of the connecting wire located between the headband and the earmuff housing is spirally disposed.

The beneficial effect of the headset provided by the embodiment of the present application is due that the connecting ring of the earphone housing and the outer end of the earmuff are connected by the universal adjuster, such that during the actual using of the headset, the earmuffs can achieve the universal adjusting relative to the earphone housing by the deformation adjusting of the universal adjuster, thereby effectively improving the fit of the earmuffs and the human ears, the user's comfort when wearing the headset is greatly increased.

BRIEF DESCRIPTION OF THE DRAWINGS

In order to explain the embodiments of the present application more clearly, a brief introduction regarding the accompanying drawings that need to be used for describing the embodiments of the present application or the prior art is given below; it is obvious that the accompanying drawings described as follows are only some embodiments of the present application, for those skilled in the art, other drawings can also be obtained according to the current drawings on the premise of paying no creative labor.

DETAILED DESCRIPTION

In order to make the purpose, the technical solution and the advantages of the present application be clearer and more understandable, the present application will be further described in detail below with reference to accompanying figures and embodiments. It should be understood that the specific embodiments described herein are merely intended to illustrate but not to limit the present application.

It is noted that when a component is referred to as being "fixed to" or "disposed on" another component, it can be directly or indirectly on another component. When a component is referred to as being "connected to" another component, it can be directly or indirectly connected to another component. In the description of the present application, it needs to be understood that, directions or location relationships indicated by terms such as "length", "width", "up", "down", "front", "rear", "left", "right", "vertical", "horizontal", "top", "bottom", "inside", "outside", and so on are the directions or location relationships shown in the accompanying figures, which are only intended to describe the present application conveniently and simplify the description, but not to indicate or imply that an indicated device or component must have specific locations or be constructed and manipulated according to specific locations; therefore, these terms shouldn't be considered as any limitation to the present application. In addition, terms "the first" and "the second" are only used in describe purposes, and should not be considered as indicating or implying any relative importance, or impliedly indicating the number of indicated technical features. As such, technical feature(s) restricted by "the first" or "the second" can explicitly or impliedly comprise one or more such technical feature(s). In the description of the present application, "a plurality of" means two or more, unless there is additional explicit and specific limitation.

In order to explain the technical solutions described in the present application, the following detailed description will be made in conjunction with the specific drawings and embodiments.

Some embodiments of the present application provide a headset.

Figure 1:
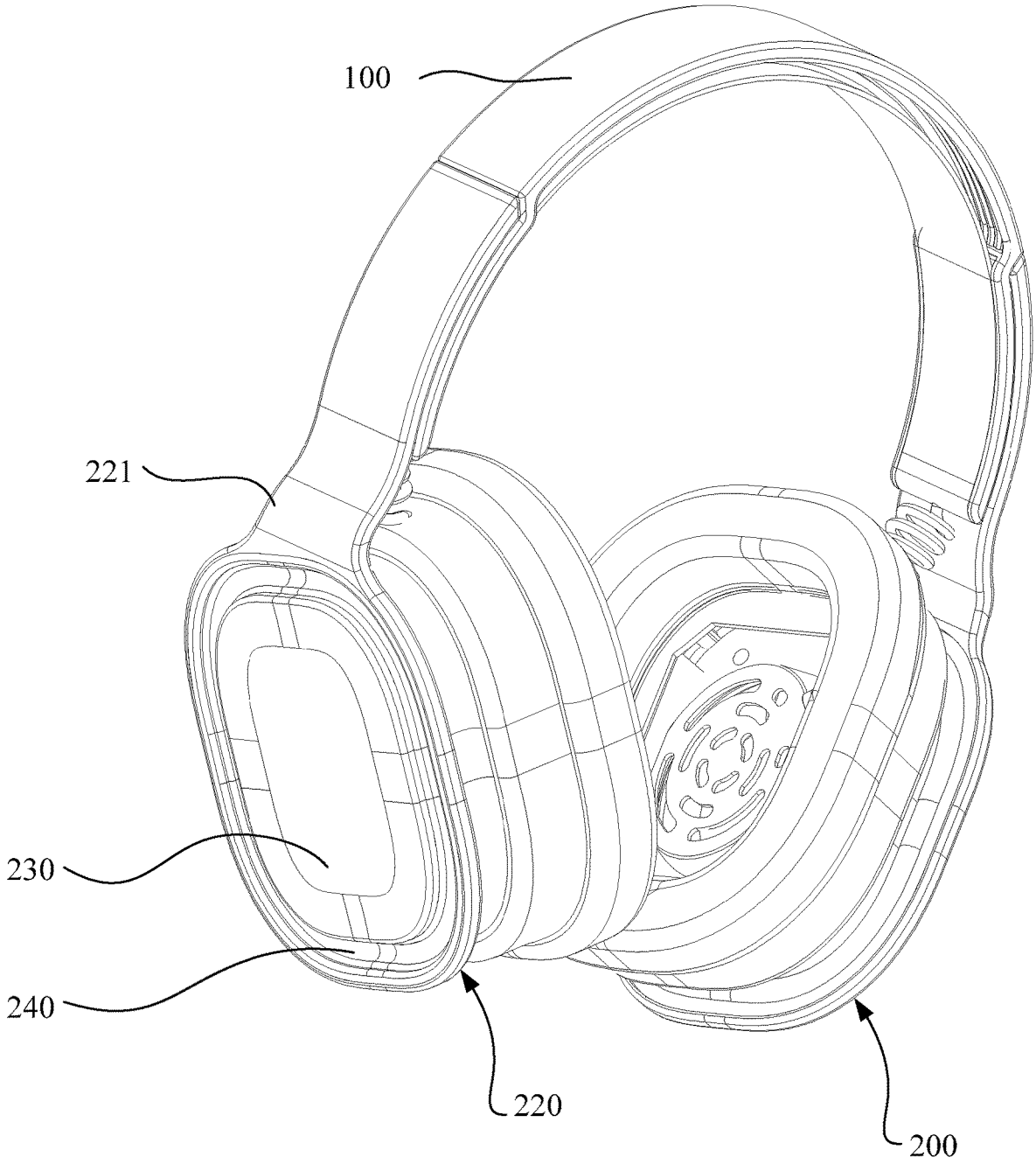
FIG. 1 is a structural schematic view of a headset according to an embodiment of the present application.
Figure 2:
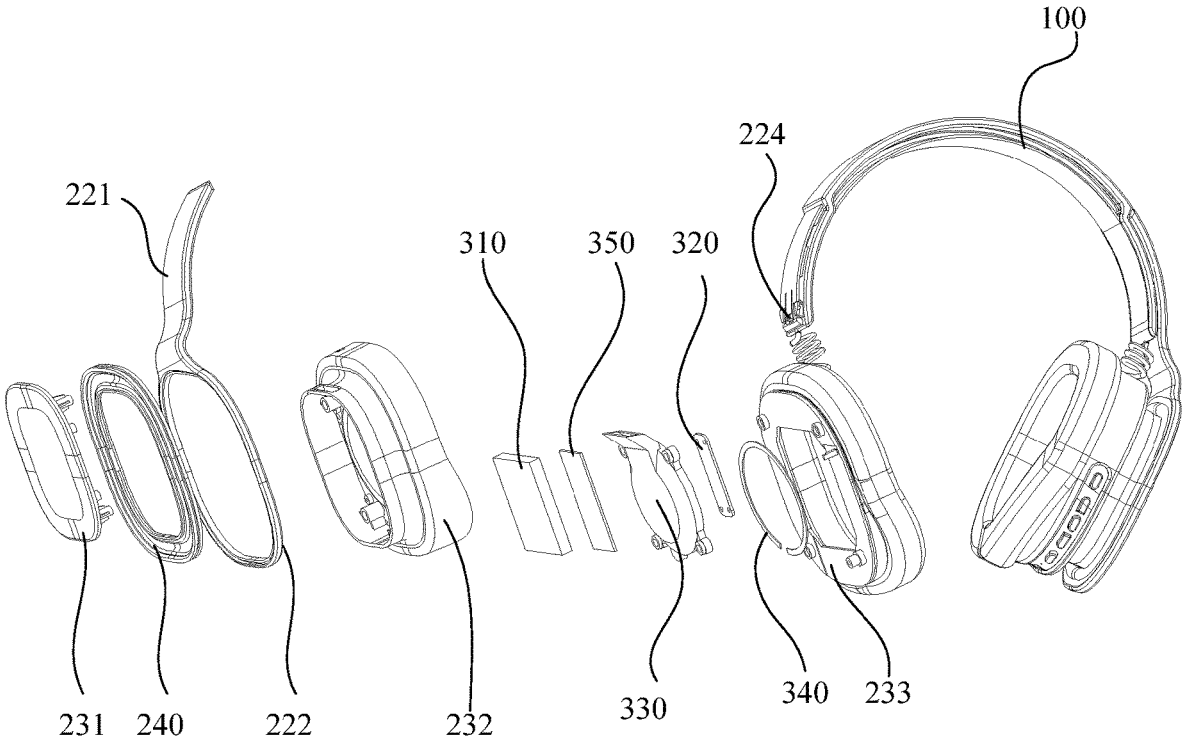
FIG. 2 is an explosion view of an angle of a headset according to an embodiment of the present application.
Figure 3:
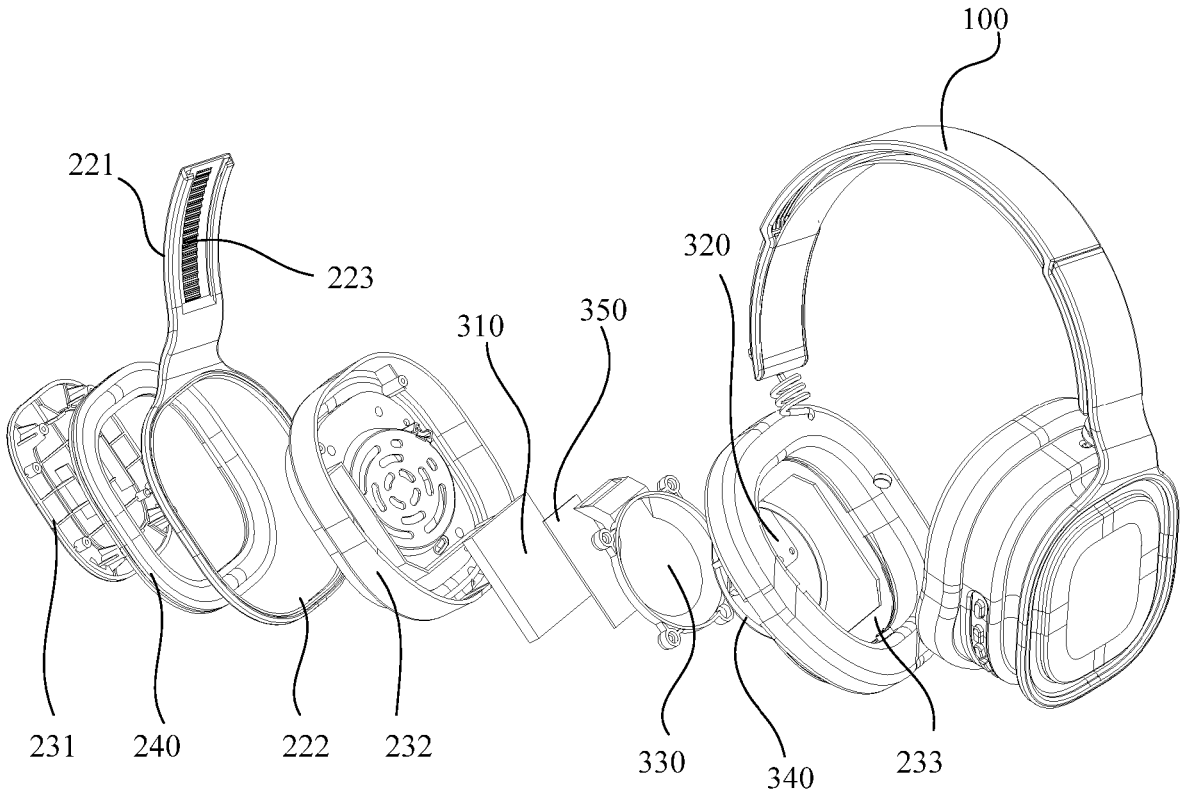
FIG. 3 is an explosion view of another angle of a headset according to an embodiment of the present application.
Figure 4:
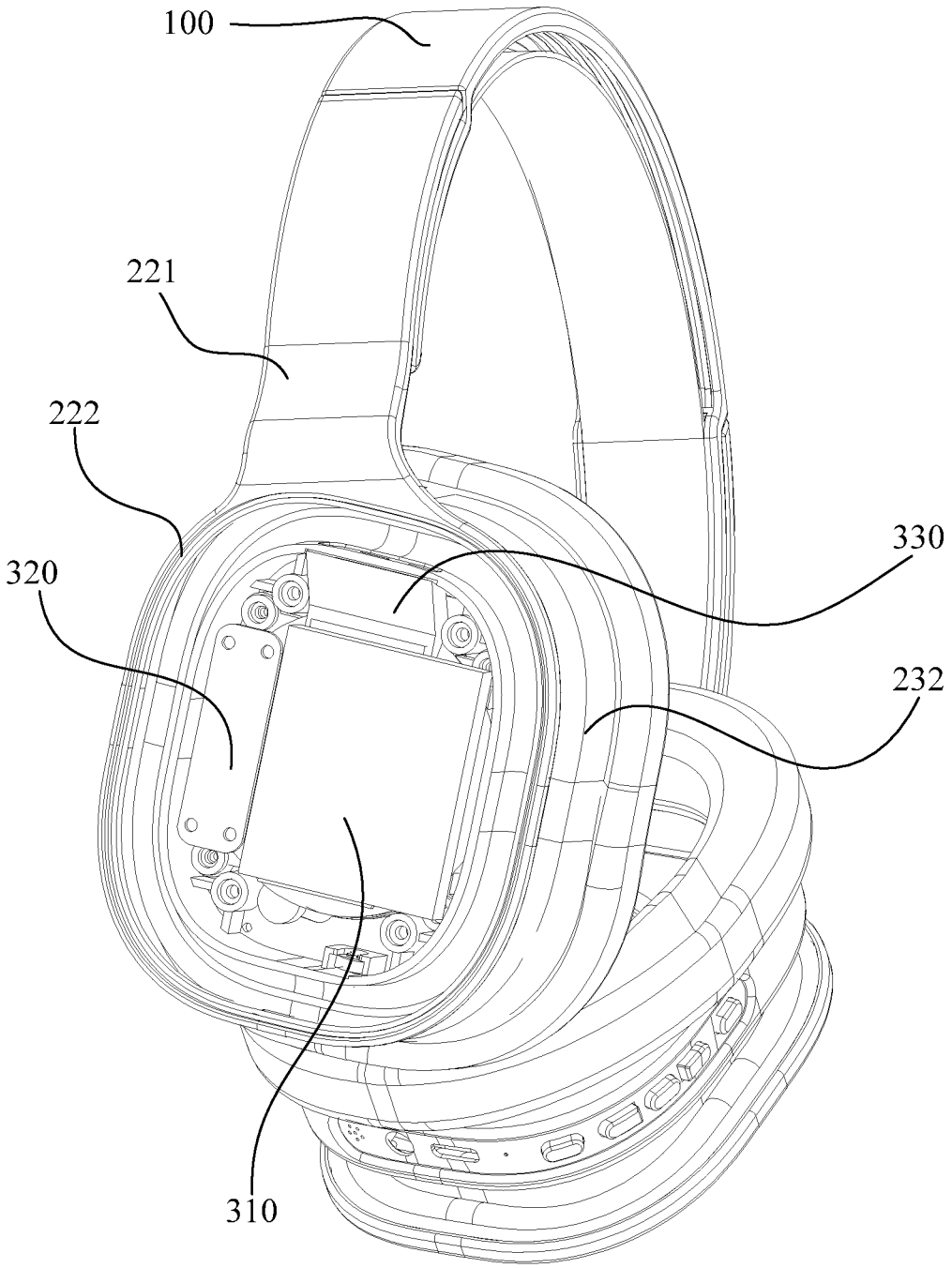
FIG. 4 is a structural schematic view of a headset according to an embodiment of the present application, wherein a universal adjuster and an outer cover are removed.
Figure 9:
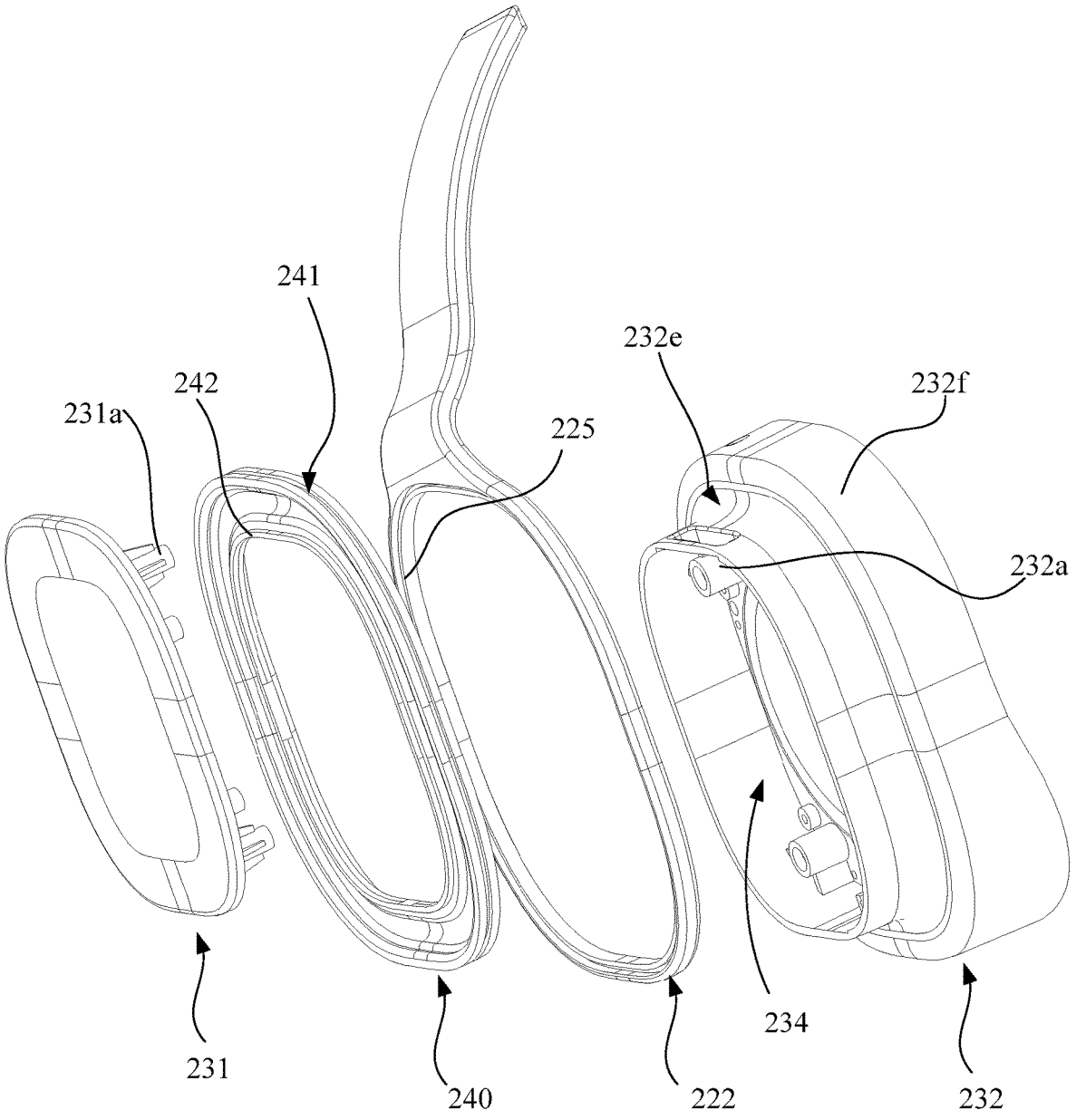
FIG. 9 is an explosion view of an earphone of a headset according to an embodiment of the present application.

Referring to FIG. 1, FIG. 2 and FIG. 9, in an embodiment, the headset includes a headband 100 and two earphones 200 respectively connected to two ends of the headband 100, wherein the earphone 200 includes an earphone housing 220, an earmuff 230, and a universal adjuster 210; the earphone housing 220 is connected to one end of the headband 100; the earmuff 230 is provided with a sounder therein; the universal adjuster 210 is connected between the earphone housing 220 and the earmuff 230 and allows the earmuff 230 to be arbitrarily adjusted relative to the earphone housing 220.

Based on this structural design, due that the connecting ring 222 of the earphone housing 220 and the outer end of the earmuff 230 are connected by the universal adjuster 210, such that during the actual using of the headset, the earmuffs 230 can achieve the universal adjusting relative to the earphone housing 220 by the deformation adjusting of the universal adjuster 210, thereby effectively improving the fit of the earmuffs 230 and the human ears, the user's comfort when wearing the headset is greatly increased.

Referring to FIG. 1 and FIG. 9, in an embodiment, an upper end of the earphone housing 220 is connected to the headband 100, and a lower end is provided with a connection ring 222 disposed in ring shape, an outer end of the earmuff 230 away from an ear is located in a space enclosed by an inner annular surface of the connecting ring 222; and the universal adjuster 210 is connected between the connecting ring 222 and an outer end of the earmuff 230, and configured to allow the earmuff 230 to be adjusted relative to the earphone housing 220. It should be specifically described that the connecting ring 222 is an empty frame, and the universal adjuster 210 is placed in the empty frame. In other words, in the embodiment, an outer annular surface of the annular universal adjuster 210 is directly attached to the inner annular surface of the connecting ring 222, and the inner annular surface of the universal adjuster 210 is also located in the space enclosed by the inner annular surface of the connecting ring 222.

In an embodiment, the universal adjuster 210 is made of at least one of a group of an elastic silicone rubber, an elastic rubber, an elastic plastic, an elastic fabric and an elastic film material, for example, the material of the universal adjuster 210 may preferably be a rubber ring or a silicone ring that is low in cost and is easy to be made. Thus, when the earmuff 230 needs to be angle-adjusted with respect to the earphone housing 220, it can be fully utilized by the elastic stretching or recovery performance of the elastic material, and the angular adjusting is very convenient. Herein, in order to maintain the uniform elastic performance of the universal adjuster 210, the universal adjuster 210 is preferably made of a same elastic soft material. Of course, in other embodiments, the universal adjuster 210 may also be made of a variety of elastic materials according to special design requirements, and the size and the like are designed as needed.

Figure 5:
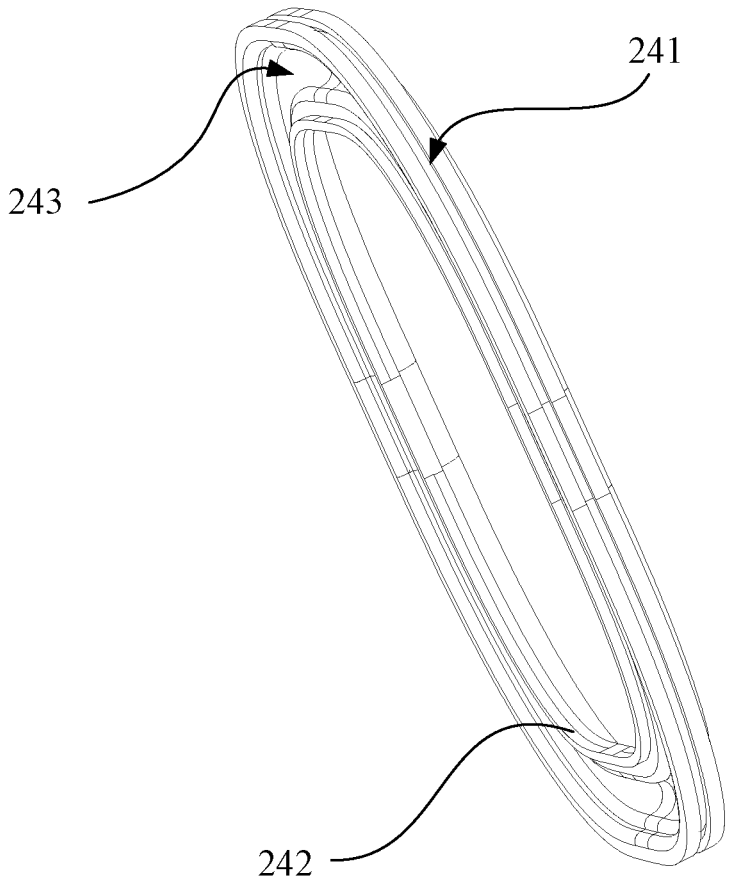
FIG. 5 is an explosion view of an angle of a universal adjuster of a headset according to an embodiment of the present application.

Referring to FIG. 1, FIG. 5 and FIG. 9, in an embodiment, the universal adjuster 210 is a universal adjusting film 240 made of an elastic film material, and the universal adjusting film 240 is annularly disposed, and an outer annular surface of the universal adjusting film 240 is connected to an inner annular surface of the connecting ring 222, and an inner annular surface of the universal adjusting film 240 is connected to an outer edge of an outer end of the earmuff 230. During the wearing of the headset, when the earmuff 230 needs to adjust the degree of fit with the human ears, the direction towards the other earphone 200 is disposed as an inner side, the partial film at the corresponding position where the earmuff 230 moving outwardly is elastically compressed, and the partial film at the corresponding position where the earmuff 230 moving inwardly is elastically stretched, so that no matter which direction the earmuff 230 is adjusted, the corresponding position of the universal adjusting film 240 will change correspondingly, thereby the universal adjusting is smoothly achieved.

In an embodiment, the universal adjusting film 240 is connected to both the connecting ring 222 and the earmuff 230 by an overmolding sealing, the assembly and manufacturing process are very convenient; and a region between the outer annular surface and the inner annular surface of the universal adjusting film is annularly disposed in a concave-convex three-dimensional, which can effectively increase the adjusting amount of the universal adjusting film 240, such that the universal adjusting of the earmuff 230 relative to the earphone housing 230 is more flexible.

In an embodiment, the outer annular surface of the universal adjusting film 240 and the inner annular surface of the connecting ring 222 is welded by ultrasonic sealing, and the inner annular surface of the universal adjusting film 240 and the outer edge of the outer end of the earmuff 230 is welded by ultrasonic sealing. Of course, in other embodiments, the universal adjusting film 240 can also be connected by means of adhesive bonding or the like, but in the embodiment, the ultrasonic sealing welding method has higher production efficiency and better connection effect. Herein, the arrangement of the sealing connection can make the connection between the universal adjusting film 240 and the earphone housing 220 and the earmuff 230 more compact on the one hand, and it is not easy to cause the angular adjusting to be unsuccessful due to the detachment of the universal adjusting film 240; on the other hand, the sealing connection can also protect the important components inside the earmuff 230, prevent water and dust from entering, and the appearance of the headphones is more simple and beautiful.

Figure 6:
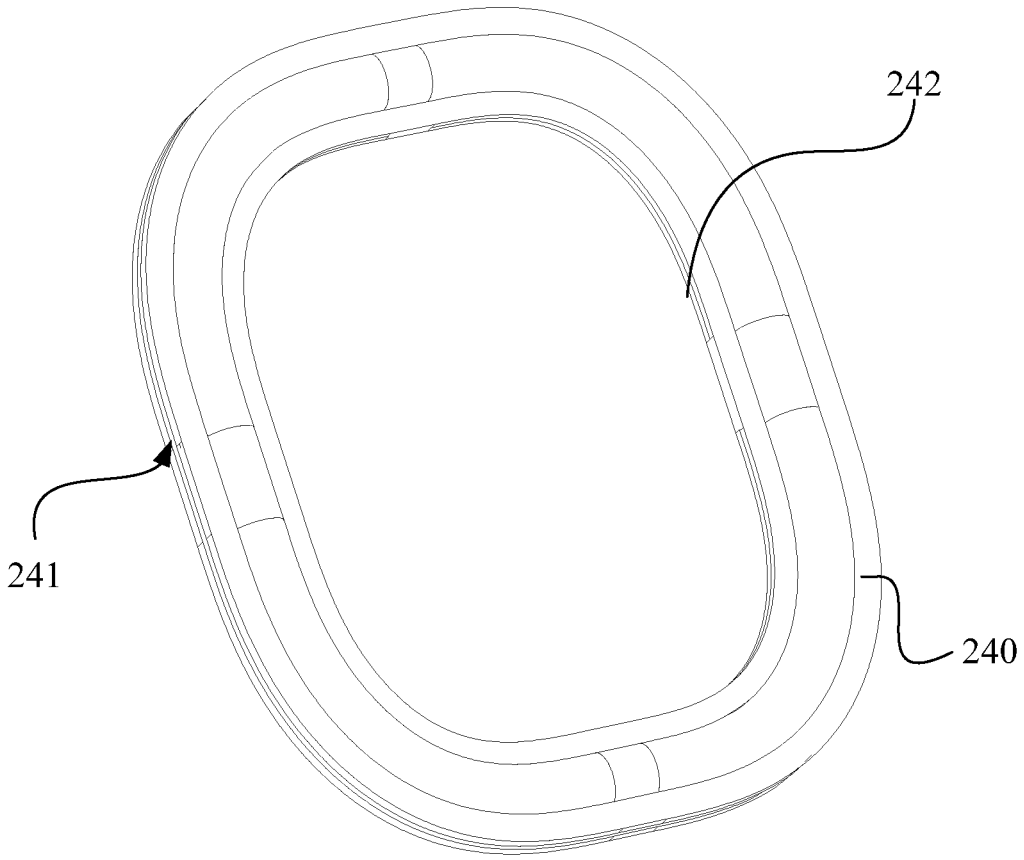
FIG. 6 is an explosion view of another angle of a universal adjuster of a headset according to an embodiment of the present application.

Referring to FIG. 5 and FIG. 6, in an embodiment, the outer annular surface of the universal adjusting film 240 is provided with a first limiting portion, and the inner annular surface of the connecting ring 222 is provided with a second limiting portion configured to be cooperated and connected with the first limiting portion, and an outer edge of the inner annular surface of the universal adjusting film extends outward to form a connecting flange 242. It can be understood that the cooperating and connecting of the first limiting portion and the second limiting portion can make the positions of the universal adjusting film 240 and the connecting ring 222 relatively fixed, thereby facilitating the forming connection, and further improving the connection tightness between the universal adjusting film 240 and the connecting ring 222. Specifically, in the embodiment, the first limiting portion is an annular limiting groove 241 disposed on the outer annular surface of the universal adjusting film 240, and the second limiting portion is an annular limiting rib 225 protruded from the inner annular surface of the connecting ring 222. However, the present design is not limited thereto. In other embodiments, the annular limiting rib 225 may be disposed on the outer annular surface of the universal adjusting film 240, and the annular limiting groove 241 is disposed on the inner annular surface of the connecting ring 222; alternatively, the annular limiting rib 225 may be replaced by a plurality of circumferentially spaced projections, and correspondingly, an adapted groove is provided on the outer annular surface of the universal adjusting film 240, which is not limited herein. In addition, the design of the connecting flange 242 can increase the effective connection area between the universal adjusting film 240 and the outer edge of the outer cover 231, thereby facilitating the reinforcement of the connection and the tightness between the two.

In an embodiment, as shown in FIG. 1, the outer end surface of the connecting flange 242 and the outer end surface of the earmuff 230 are in a same horizontal plane, such that the appearance of the headset is more concise and beautiful, and it is difficult to accumulate dust and the like in the gap. In addition, a region between the outer annular surface and the inner annular surface of the universal adjusting film 240 is recessed inwardly to form an annular inner groove 243. The inner groove 243 is designed to effectively increase the adjusting amount of the universal adjusting film 240, such that the universal adjusting of the earmuff 230 relative to the earphone housing 220 is more flexible. Of course, in other embodiments, the region between the outer annular surface and the inner annular surface of the universal adjusting film 240 may also be outwardly convex, but in the present embodiment, the design of recessed inwardly can prevent the universal adjusting film 240 from wearing and damaging when being designed outwardly convex.

In an embodiment, the connecting ring 222 is disposed coaxially with the earmuff 230, and the universal adjusting film 240 is uniform along the width of each radial direction. In this way, the adjusting amount of the universal adjusting film 240 in all directions is uniform, thereby facilitating the universal adjusting of the earmuff 230 relative to the earphone housing 220, thereby improving the comfort of the headset wearing.

Figure 13:
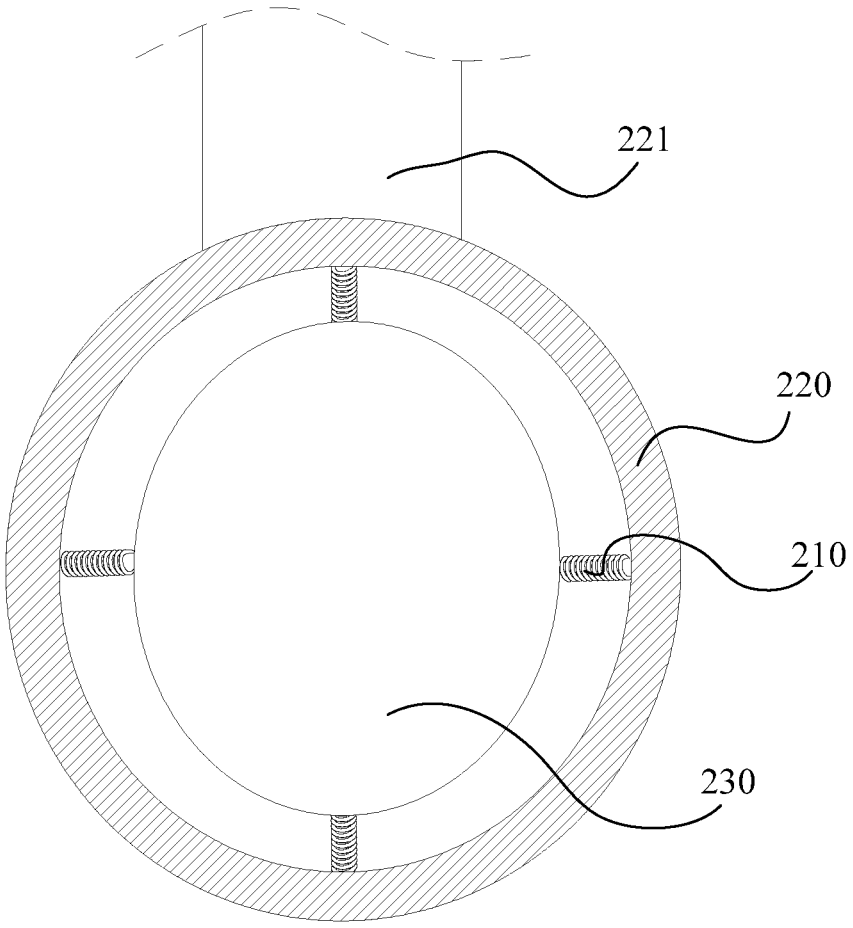
FIG. 13 is a sectional schematic view of a part structure of a headset according to an embodiment of the present application.

Referring to FIG. 13, in another embodiment, the universal adjuster 210 may also be a plurality of springs connected between the earphone housing 220 and the earmuff 230. The specific number of springs is four, with two springs being disposed relatively coaxially, and the other two springs being also disposed relatively coaxially; and the axes of the two opposite springs are perpendicular to the axes of the other two opposite springs. In this way, not only the structural design is simple, it is easy to assemble, and the angle and position adjusting of the up, down, left and right directions can be well taken into consideration at the same time, and the arranging of the opposite springs disposed coaxially can make the springs reduce the useless elastic moment and deformation as much as possible during the elastic deformation, thereby increasing the life of the springs. Of course, in other embodiments, it is also possible to set a suitable number of springs according to actual design needs, but it is preferable to set the number to an even number to obtain a better balance of adjusting force.

In an embodiment, at least one end of the spring is pivotally connected to the earphone housing 220 or the earmuff 230. Thus, the multi-axial rotation of the earmuff 230 relative to the earphone housing 220 can be achieved, and a better angle and position adjusting effect can be obtained with the cooperating of the elastically deformed of the springs.

Referring to FIGS. 2 to 4, and FIG. 9, in an embodiment, the earmuff 230 includes an earmuff housing 232, an outer cover 231, and an inner cover 233. The earmuff housing 232 has a mounting cavity 234 designed having an opening outward. The sounding assembly is placed in the mounting cavity 234, the outer cover 231 is detachably attached to the opening of the mounting cavity 234, and the inner cover 233 is detachably connected to the earmuff housing 232. Thus, the universal adjusting film 240 is convenient to be installed and fixed and it also facilitates the assembly of the entire earmuff 230. In this embodiment, the earphone housing 220 has a mounting cavity 234, and the sounding assembly is placed in the mounting cavity 234, the sounding assembly includes a battery 310, a PCB board 320, and a horn. The horn (not shown) is electrically connected to the battery 310 and the PCB board 320, respectively, such that the sound release function of the headset can be realized. In addition, in the mounting cavity 234, a double-sided adhesive tape 350, a horn rear cover 330, a sealing ring 340 and the like are further provided. The double-sided adhesive tape 350 is used for bonding and fixing the battery 310, and the horn rear cover 330 and the earmuff housing 232 are enclosed to form an accommodating space for mounting the horn, the sealing ring 340 is disposed between the horn rear cover 330 and an inner cover 233 of the earmuff 230 to provide a certain sealing effect.

Figure 10:
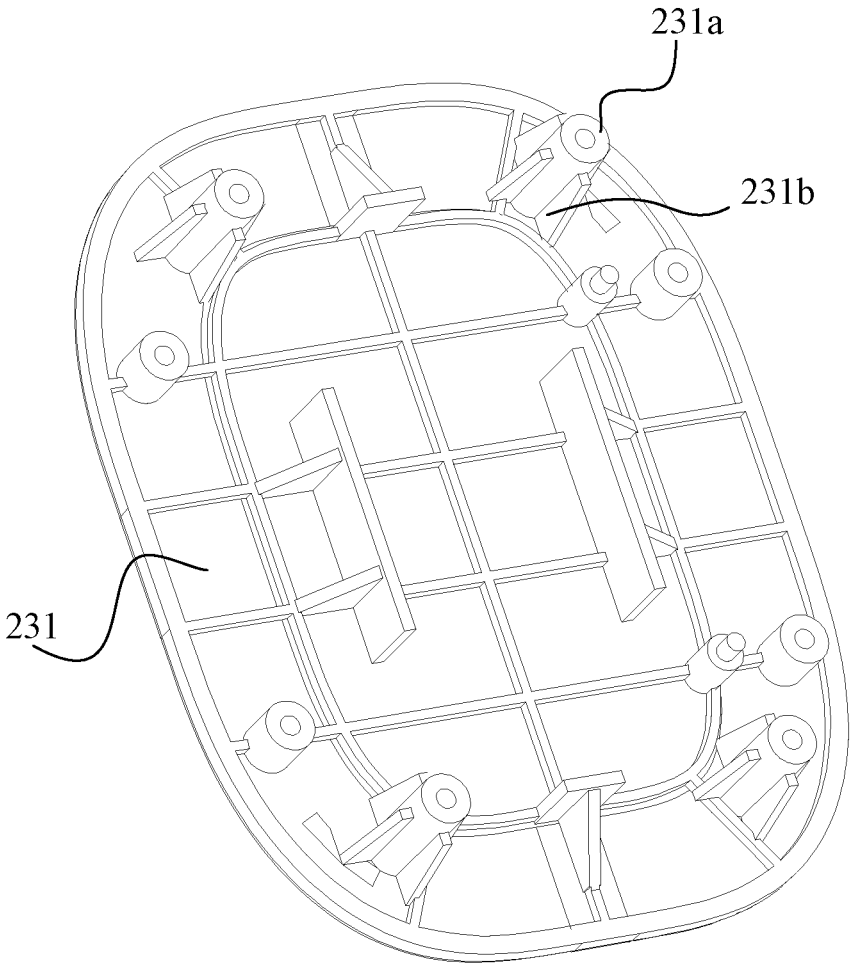
FIG. 10 is a structural schematic view of an outer cover of a headset according to an embodiment of the present application.
Figure 11:
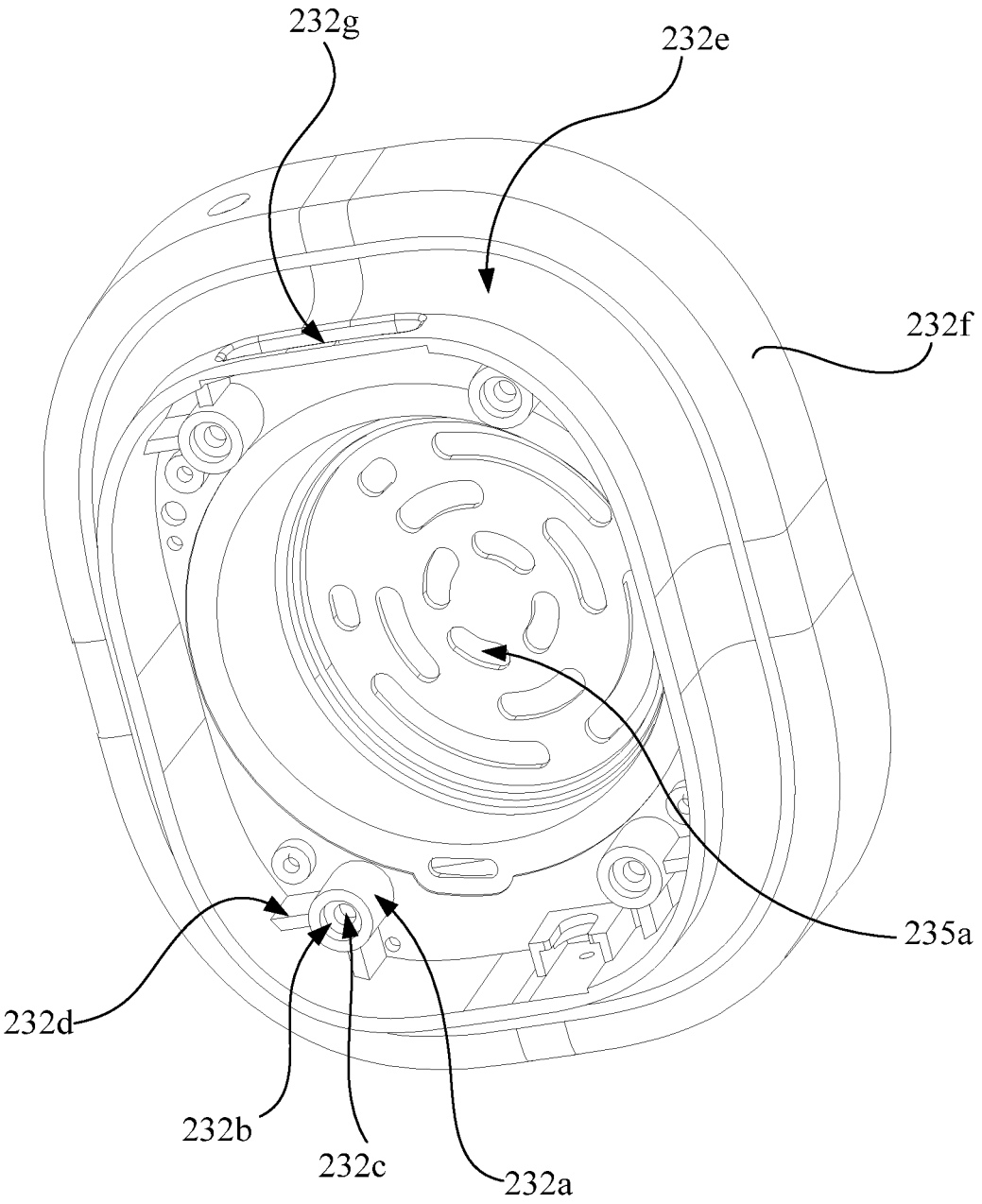
FIG. 11 is a structural schematic view of an angle of an earmuff of a headset according to an embodiment of the present application.
Figure 12:
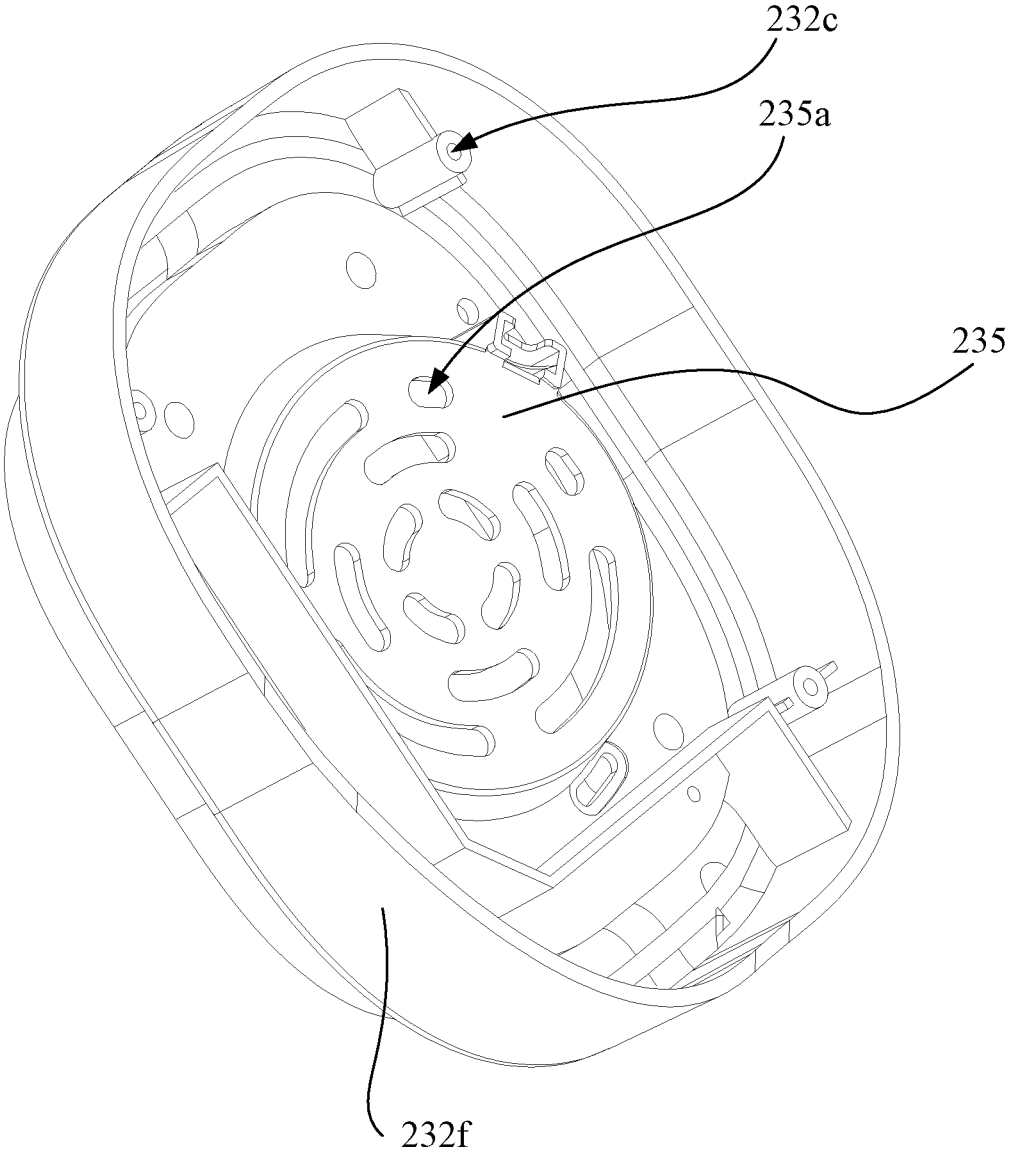
FIG. 12 is a structural schematic view of another angle of an earmuff of a headset according to an embodiment of the present application.

Referring to FIGS. 10 to 12 together, in an embodiment, the outer cover 231 is detachably screwed from the earmuff housing 232. Of course, in other embodiments, the outer cover 231 and the earmuff housing 232 can be connected by other detachable means such as, but not limited to engaging. However, in the embodiment, the screwing manner can make the outer cover 231 and the earmuff housing 232 more securely connected. Specifically, in this embodiment, a plurality of first screw posts 231*a* are spaced apart on the inner surface of the outer cover 231, and each of the first screw posts 231*a* is provided with a screw hole having an internal thread, a bottom of the mounting cavity 234 of the earmuff housing 232 is protruded with second screw posts 232*a* configured to be cooperated and connected with the first screw posts 231*a*, and the second screw post 232*a* is provided a through hole 232*c* passing through the second screw post 232*a* along an axial direction, and a connecting member passes through the through hole 232*c* and is screwed to the first screw post 231*a*.

Referring to FIG. 10 to FIG. 12, in an embodiment, the second screw post 232*a* is recessed toward the front end surface of the first screw post 231*a* to form a limiting hole 232*b*, and the through hole 232*c* is disposed in a bottom of the limiting hole 232*b*, a rear end of the first screw post 231*a* is inserted into the limiting hole 232*b*, and the rear end surface of the first screw post 231*a* abuts against the bottom surface of the limiting hole 232*b*. In this way, the assembly of the first screw post 231*a* and the second screw post 232*a* can be ensured in place, thereby ensuring that the size, volume, etc. of the mounting cavity 234 are consistent with the design, and the design can also ensure the important components mounted in the mounting cavity 234 are not damaged by crushing during assembly. In addition, as shown in FIG. 11 and FIG. 12, a plurality of limiting reinforcing ribs 231*b* are disposed on the outer peripheral side of the first screw post 231*a*, and configured to mainly serve to strengthen the connection between the first screw post 231*a* and the inner side surface of the outer cover 231, and to strengthen the limiting when the first screw post 231*a* is inserted into the limiting hole 232*b*; similarly, the outer peripheral side of the second screw post 232*a* is also provided with a plurality of reinforcing ribs 232*d* to strengthen the strength of the connection between the second screw post 232*a* and the earmuff housing 232.

Referring to FIG. 9 to FIG. 10, in an embodiment, the outer cover 231 has a rectangular design with rounded corners at four corners, and the four first screw posts 231 a are respectively disposed adjacent to the four corners of the outer cover 231. Thus, during assembling, the four corners of the outer cover 231 can be fixed, and the connection strength is evenly distributed. In addition, a plurality of positioning pieces are further spaced apart on the inner side surface of the outer cover 231, and are mainly used for abutting the battery 310 after being assembled to prevent the battery 310 from moving. The bottom surface of the mounting cavity 234 protrudes inwardly to form a sounding boss 235, the sounding boss 235 is provided with a plurality of sounding holes 235*a* disposed passing through the sounding boss, and the sound emitted by the horn can be emitted through the sounding hole 235*a*. Herein, the setting of the sounding boss 235 effectively increases the volume of the mounting cavity 234, the installation of the horn is facilitated, and the horn is disposed adjacent to the ear of human ears, and the sound effect is better. In addition, the earmuff 230 further includes an inner cover 233. The inner cover 233 and the earmuff housing 232 can be detachably connected by screwing or the like, and the inner cover 233 is provided with a large through hole for the sounding boss 235 to be exposure. The inner side surface of the inner cover 233 is connected with a soft ring sleeve configured to be fit with human ear, the ring sleeve is filled with a soft material such as a sponge to make the headset more comfortable to wear.

Referring to FIGS. 9 and 11, in an embodiment, the outer peripheral side surface of the earmuff housing 232 includes an annular remaining area 232*e* on a side adjacent to the connecting ring 222, and an inner side area 232*f* on a side away from the connecting ring 222. The retaining area 232*e* is an annular groove concavely disposed, and the inner side area 232*f* is provided with a first through hole 232*h* configured for the connecting wire 400 to be passed through. Since the remaining area 232*e* is concavely disposed, that is, the joint between the earmuff housing 232 and the outer cover 231 is lower than the outer peripheral plane of the inner side area 232*f*, thereby, a sufficient movement space can be provided for the movement of the universal adjuster 210, such that the angular adjusting of the earmuff 230 relative to the earphone housing 220 is more flexible.

In an embodiment, as shown in FIG. 11, a top of the remaining area 232*e* adjacent to the headband 100 is provided with a second through hole 232*g*, and the second through hole 232*g* is in communication with the sounding assembly. The second through hole 232*g* is in communication with a vibrating cavity of an upper opening provided on the horn rear cover 330 to further improve the sound effect of the horn, so that the headset can obtain a better use experience.

Figure 7:
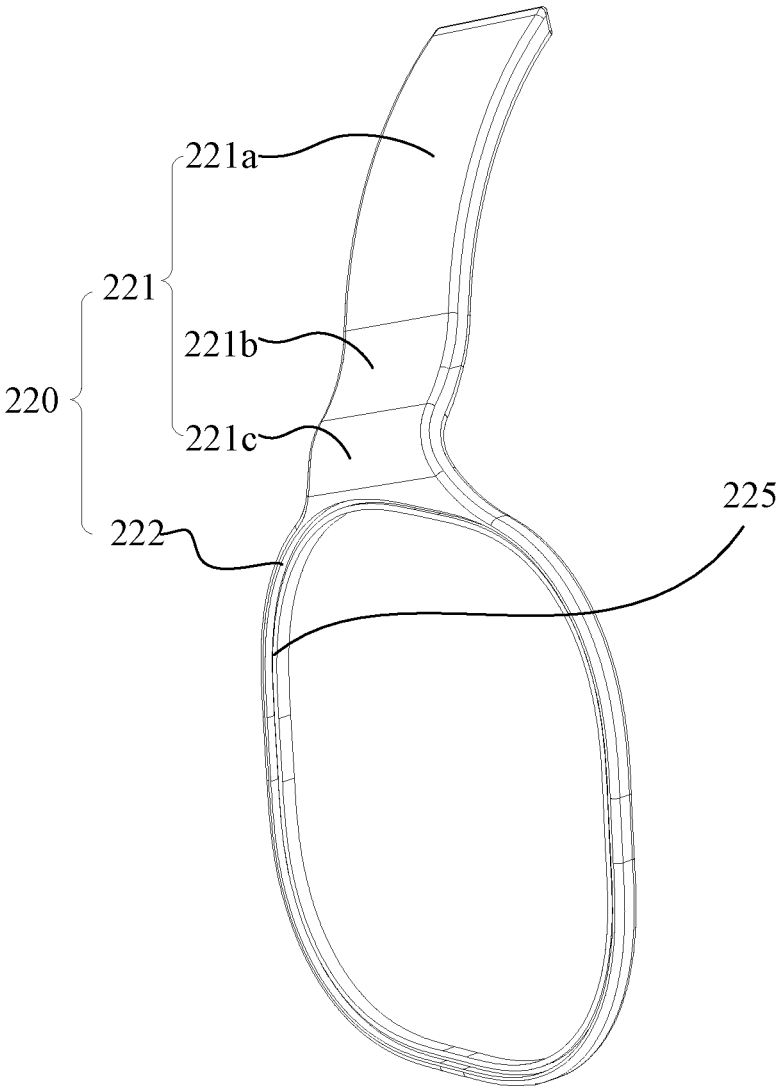
FIG. 7 is an explosion view of an angle of a stretching arm and a connecting ring of a headset according to an embodiment of the present application.
Figure 8:
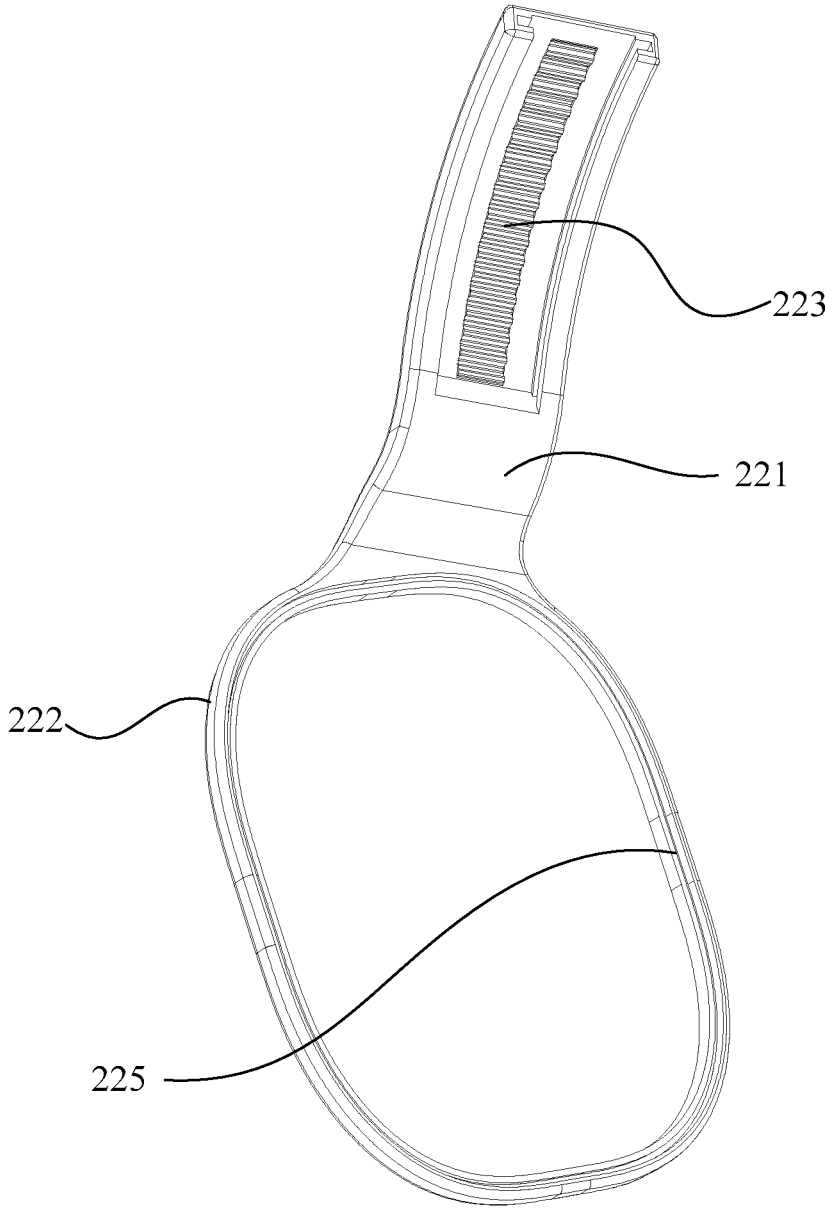
FIG. 8 is an explosion view of another angle of a stretching arm and a connecting ring of a universal adjuster of a headset according to an embodiment of the present application.

Referring to FIG. 2, FIG. 3, FIG. 7, and FIG. 8, in an embodiment, the headset further includes a stretching arm structure and a connecting wire 400; the stretching arm structure includes a stretching arm 221 and a position adjusting mechanism, and two ends of the stretching arm 221 are respectively connected to the headband 100 and the connecting ring 222, the position adjusting mechanism is disposed between the stretching arm 221 and the headband 100, and the stretching arm 221 can adjust the relative position of the headband 100 in the up and down direction by the position adjusting mechanism; one end of the connecting wire 400 passes through the headband 100 and is electrically connected to the other earphone 200, and the other end is electrically connected to the sounding assembly after passing through the earmuff housing 232, and a part of the connecting wire 400 located between the headband 100 and the earmuff housing 230 is in a curved state, so when the earmuff 230 is universally adjusted, the curved connecting wire 400 can adjust the length adaptively, so that the angular adjusting of the earmuff 230 is not interfered or affected, and the angular adjusting of the earmuff 230 is more flexible. In an embodiment, as shown in FIGS. 7 and 8, the stretching arm 221 includes a first connecting portion 221*a*, a second connecting portion 221*b*, and a third connecting portion 221*c* that are sequentially connected, and the bending curvature of the first connecting portion 221*a* is identical with that of the headband 100 and connected to the headband 100; two ends of the second connecting portion 221*b* are respectively connected to the first connecting portion 221*a* and the third connecting portion 221*c*, and the second connecting portion 221*b* is has an arc shape and concavely designed. Herein, the earphone housing 220 can be integrally formed from plastic, and the wave-concave design of the stretching arm 221 not only benefits the appearance of the headset, but also effectively enhances the structural strength of the entire earphone housing 220. Of course, the arc shape and concavely designed of the third connecting portion 221*c* can also provide a certain avoidance space for the adjusting of the connecting wire 400 of the earmuff 230.

In an embodiment, the stretching arm 221 is integrally provided with the connecting ring 222 such that the two are more securely connected and convenient for molding, and the appearance is more concise and beautiful.

Referring to FIGS. 2 and 8, in an embodiment, the position adjusting mechanism includes a resilient adjusting buckle 224 disposed at a lower end of the outer side surface of the headband 100, and an adjusting latching position 223 disposed at an inner side surface of the first connecting portion 221*a* and extended along a length direction of the stretching arm 221, a section the adjusting latching position 223 is in a sawtooth shaped, and with the adjusting buckle 224 engaging at different positions of the adjusting latching position 223, the first connecting portion 221*a* is achieved to adjust a position relative to the headband 100.

In one embodiment, a part of the connecting wire 400 located between the headband 100 and the earmuff housing 232 is spirally disposed. Of course, in other embodiments, the partial connection wire 400 may also be disposed in other curved shapes, but in the embodiment, the spiral curved design can increase the effective adjusting length of the connection wire 400 as much as possible, so as not to interfere the technical purpose of affecting the angular adjusting motion of the earmuff 230 as much as possible.

The aforementioned embodiments are only preferred embodiments of the present application. For one of ordinary skill in the art, according to the thought of the present application, specific implementation modes and application scopes may be modified, and the content of the specification should not be interpreted as any limitation to the present application.

What is claimed is:

1. A headset, comprising:

a headband; and two earphones, respectively connected to two ends of the headband, wherein each earphone comprising:

an earphone housing, connected to an end of the headband;

an earmuff, provided with a built-in sounder; and a universal adjuster, connected between the earphone housing and the earmuff and configured to arbitrarily adjust the earmuff relative to the earphone housing;

wherein an upper end of the earphone housing is connected with the headband, and a lower end is provided with a connecting ring annularly disposed, an outer end of the earmuff away from an ear is located in a space enclosed by an inner annular surface of the connecting ring; and the universal adjuster is connected between the connecting ring and an outer end of the earmuff, and configured to allow the earmuff to be adjusted relative to the earphone housing; and wherein the earmuff comprises an earmuff housing, an outer cover and an inner cover; the earmuff housing defines a mounting cavity designed having an opening outward, and the sounder is placed in the mounting cavity, and the outer cover is detachably attached to the opening of the mounting cavity, and the inner cover is detachably connected with the earmuff housing.

2. The headset according to claim 1, wherein the universal adjuster is made of a material of at least one of the group of elastic silicone, elastic rubber, elastic plastic, elastic fabric and elastic film material.

3. The headset according to claim 2, wherein the universal adjuster is a universal adjusting film made of an elastic film material, and the universal adjusting film is annularly disposed, an outer annular surface of the universal adjusting film is connected to an inner annular surface of the connecting ring, and an inner annular surface of the universal adjusting film is connected to an outer edge of an outer end of the earmuff.

4. The headset according to claim 3, wherein the universal adjusting film is connected to the connecting ring and the earmuff by an overmolding sealing, and a region between the outer annular surface and the inner annular surface of the universal adjusting film is annularly disposed in a concave-convex three-dimensional shape.

5. The headset according to claim 4, wherein the outer annular surface of the universal adjusting film and the inner annular surface of the connecting ring is welded by ultrasonic sealing, and the inner annular surface of the universal adjusting film and the outer edge of the outer end of the earmuff is welded by ultrasonic sealing.

6. The headset according to claim 3, wherein the outer annular surface of the universal adjusting film is provided with a first limiting portion, and the inner annular surface of the connecting ring is provided with a second limiting portion configured to be cooperated and connected with the first limiting portion, and an outer edge of the inner annular surface of the universal adjusting film extends outward to form a connecting flange.

7. The headset according to claim 3, wherein the connecting ring is disposed coaxially with the earmuff, and the universal adjusting film has a uniform width along each radial direction.

8. The headset according to claim 1, wherein the universal adjuster is a plurality of springs connected between the earphone housing and the earmuff.

9. The headset according to claim 8, wherein a number of the springs are four, and two of the springs are coaxially disposed opposite to each other, and the other two of the springs are also coaxially disposed opposite to each other; and an axes of the two opposite springs are perpendicular to an axes of the other two opposite springs.

10. The headset according to claim 8, wherein at least one end of the spring is pivotally connected to the earphone housing or the earmuff.

11. The headset according to claim 1, wherein a plurality of first screw posts are spaced apart from each other on the inner surface of the outer cover, and each of the first screw posts is provided with a threaded hole having an internal thread, a bottom of the mounting cavity of the earmuff is protruded with second screw posts configured to be cooperated and connected with the first screw posts, and the second screw post is provided a through hole passing through the second screw post along an axial direction, and a connecting member passes through the through hole and is screwed to the first screw post.

12. The headset according to claim 1, wherein an outer peripheral side of the earmuff housing comprises an annular retaining area located on a side adjacent to the connecting ring, and an inner side area located on a side away from the connecting ring, the retaining area is disposed in a concave annular groove, and the inner side area is provided with a first through.

13. The headset according to claim 12, wherein a top of the remaining area adjacent to the headband is provided with a second through hole, and the sounder through hole is in communication with the sounder.

14. The headset according to claim 1, wherein the headset further comprises a stretching arm structure and a connecting wire;

the stretching arm structure comprises a stretching arm and a position adjusting mechanism, and two ends of the stretching arm are respectively connected to the headband and the connecting ring, and the position adjusting mechanism is disposed between the stretching arm and the headband, the stretching arm is configured to adjust a relative position with the headband in an up and down direction by the position adjusting mechanism;

one end of the connecting wire passes through the headband and is electrically connected to the other earphone, and the other end is electrically connected to the sounding assembly the sounder after passing through the earmuff housing, and a part of the connecting wire located between the headband and the earmuff housing is in a curved state.

15. The headset according to claim 14, wherein the stretching arm comprises a first connecting portion, a second connecting portion and a third connecting portion which are sequentially connected, and a bending curvature of the first connecting portion is in consistent with the headband and is connected to the headband; two ends of the second connecting portion are respectively connected to the first connecting portion and the third connecting portion, and the second connecting portion is in an arc-shaped design concaved inside; the third connecting portion is connected to the connecting ring and is in an arc-shaped design concaved outwardly.

16. The headset according to claim 15, wherein the stretching arm is integrally disposed with the connecting ring.

17. The headset according to claim 15, wherein the position adjusting mechanism comprises a resilient adjusting buckle disposed at a lower end of an outer side surface of the headband, and an adjusting latching position disposed at an inner side surface of the first connecting portion and extended along a length direction of the stretching arm, a section the adjusting latching position is in a sawtooth shaped, and with the adjusting buckle engaging at different positions of the adjusting latching position, the first connecting portion is achieved to adjust a position relative to the headband.

18. The headset according to claim 14, wherein a part of the connecting wire located between the headband and the earmuff housing is spirally disposed.

19. A headset, comprising:

a headband; and two earphones, respectively connected to two ends of the headband, wherein each earphone comprising:

an earphone housing, connected to an end of the headband;

an earmuff, provided with a built-in sounder; and a universal adjuster, connected between the earphone housing and the earmuff and configured to arbitrarily adjust the earmuff relative to the earphone housing;

wherein an upper end of the earphone housing is connected with the headband, and a lower end is provided with a connecting ring annularly disposed, an outer end of the earmuff away from an ear is located in a space enclosed by an inner annular surface of the connecting ring; and the universal adjuster is connected between the connecting ring and an outer end of the earmuff, and configured to allow the earmuff to be adjusted relative to the earphone housing;

wherein the universal adjuster is a universal adjusting film made of an elastic film material, and the universal adjusting film is annularly disposed, an outer annular surface of the universal adjusting film is connected to an inner annular surface of the connecting ring, and an inner annular surface of the universal adjusting film is connected to an outer edge of an outer end of the earmuff; and wherein the universal adjusting film is connected to the connecting ring and the earmuff by an overmolding sealing, and a region between the outer annular surface and the inner annular surface of the universal adjusting film is annularly disposed in a concave-convex three-dimensional shape.

20. A headset, comprising:

a headband; and two earphones, respectively connected to two ends of the headband, wherein each earphone comprising:

an earphone housing, connected to an end of the headband;

an earmuff, provided with a built-in sounder; and a universal adjuster, connected between the earphone housing and the earmuff and configured to arbitrarily adjust the earmuff relative to the earphone housing;

wherein an upper end of the earphone housing is connected with the headband, and a lower end is provided with a connecting ring annularly disposed, an outer end of the earmuff away from an ear is located in a space enclosed by an inner annular surface of the connecting ring; and the universal adjuster is connected between the connecting ring and an outer end of the earmuff, and configured to allow the earmuff to be adjusted relative to the earphone housing;

wherein the universal adjuster is a universal adjusting film made of an elastic film material, and the universal adjusting film is annularly disposed, an outer annular surface of the universal adjusting film is connected to an inner annular surface of the connecting ring, and an inner annular surface of the universal adjusting film is connected to an outer edge of an outer end of the earmuff; and wherein the outer annular surface of the universal adjusting film is provided with a first limiting portion, and the inner annular surface of the connecting ring is provided with a second limiting portion configured to be cooperated and connected with the first limiting portion, and an outer edge of the inner annular surface of the universal adjusting film extends outward to form a connecting flange.

* * * * *